US007316098B1

(12) United States Patent
Sackett

(10) Patent No.: US 7,316,098 B1
(45) Date of Patent: Jan. 8, 2008

(54) DEVICE AND METHOD FOR INTERCONNECTING FRAMING COMPONENTS

(76) Inventor: Gerald L. Sackett, 2288 Rose Hill Church La., Charlottesville, VA (US) 22902

( * ) Notice: Subject to any disclaimer, the term of this patent is extended or adjusted under 35 U.S.C. 154(b) by 399 days.

(21) Appl. No.: 10/935,501

(22) Filed: Sep. 7, 2004

(51) Int. Cl.
*E04B 7/04* (2006.01)
*E04B 1/38* (2006.01)
*E04C 5/00* (2006.01)

(52) U.S. Cl. ..... 52/92.2; 52/92.1; 52/715; 52/712

(58) Field of Classification Search ..... 52/712, 52/702, 714, 715, 92.1, 92.2, 280
See application file for complete search history.

(56) References Cited

U.S. PATENT DOCUMENTS 4,571,114 A 2/1986 Rionda
4,714,372 A 12/1987 Commins
5,109,646 A 5/1992 Colonias
5,488,810 A * 2/1996 Horton ..... 52/715
5,561,949 A 10/1996 Knoth
5,653,079 A * 8/1997 Loeffler et al. ..... 52/712
6,138,425 A * 10/2000 Wendt ..... 52/506.07
6,219,975 B1 4/2001 Olden
6,295,781 B1 10/2001 Thompson
6,332,299 B1 * 12/2001 Stewart, III ..... 52/696
6,364,374 B1 * 4/2002 Noone et al. ..... 285/424
6,607,086 B1 * 8/2003 Gretz ..... 211/123
7,178,305 B2 * 2/2007 Petrova ..... 52/715

* cited by examiner

*Primary Examiner*—Carl D. Friedman
*Assistant Examiner*—Hunter Dreidame
(74) *Attorney, Agent, or Firm*—Denis R. O'Brien

(57) ABSTRACT

The present invention is a framing component interconnecting device that is particularly useful for interconnecting a spanning member and its supporting components. While the device may be used in a number of ways to facilitate frame construction, the preferred mode of use is to pre-attach it at the bearing points of a spanning member during pre-assembly of the spanning member. Because the device is not obtrusive while it is in what is referred to herein as a "non-deployed configuration," the device thus attached to a spanning member does not hinder or complicate storing, transporting, and handling the spanning member. The device incorporates an anchor strap and connecting flaps that can be deployed in order to interconnect the spanning member to its supporting component once the spanning member has been raised into position. In its deployed configuration, the device anchors, orients, braces, and interconnects one framing component to another.

18 Claims, 5 Drawing Sheets

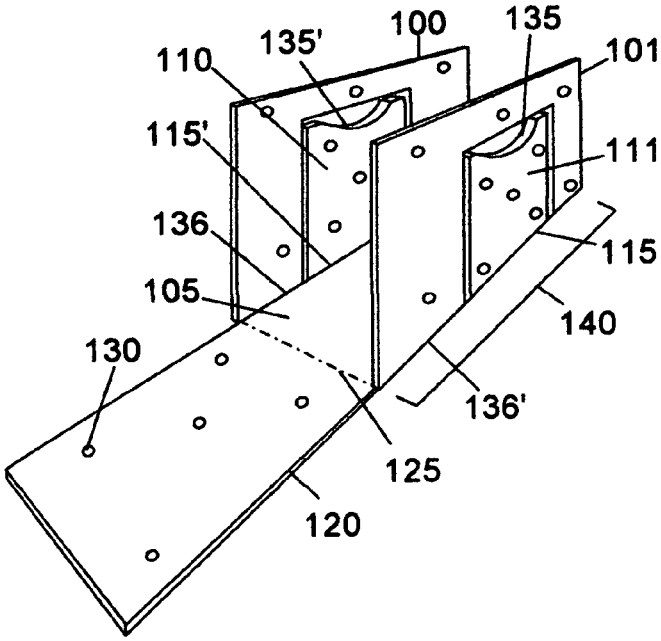
Fig 1.
Fig 2.
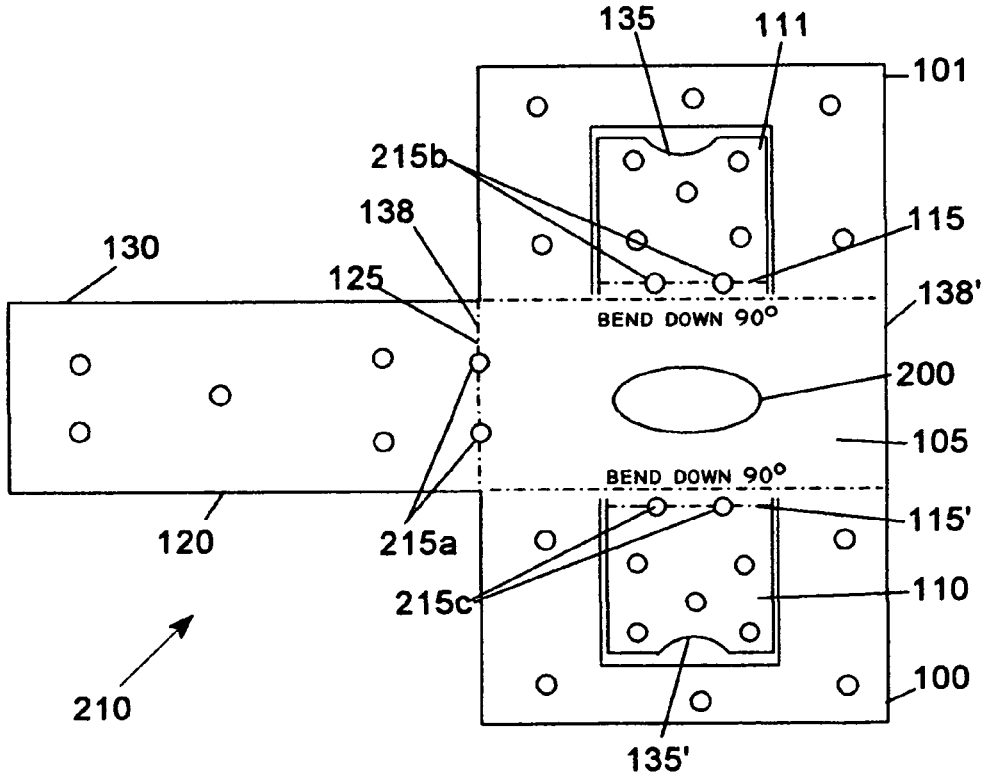

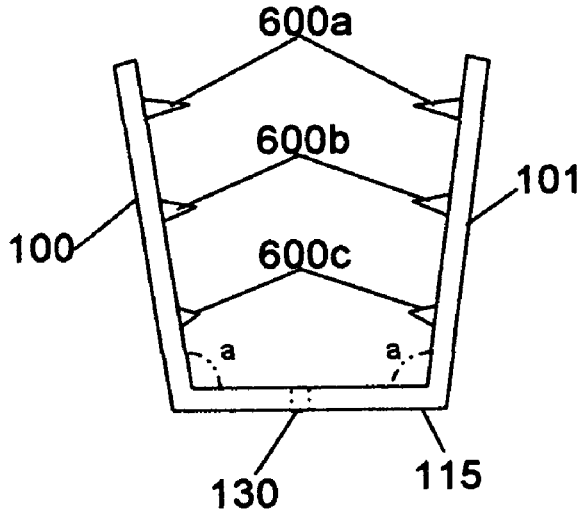
Fig 6.
Fig 7.
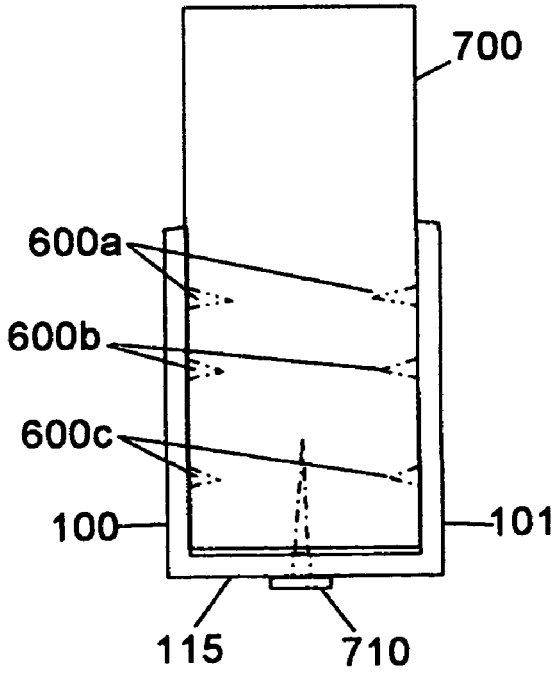

DEVICE AND METHOD FOR INTERCONNECTING FRAMING COMPONENTS

BACKGROUND OF THE INVENTION

1. Field of the Invention

My invention relates to devices for facilitating the construction on of frame buildings and other frame structures, and more specifically, my invention relates to devices for simultaneously anchoring, orienting, bracing and interconnecting framing components, particularly spanning members and supporting components.

2. Problems Solved by the Invention

Frame-based buildings are normally constructed by initially assembling a frame from a plurality of elemental framing components. The elemental framing components are typically elongated pieces of wood or metal having a rectangular or square cross-section. Of particular interest with respect to the present invention are spanning members, which are defined herein as framing components that span a space and are supported by two or more supporting components. Generally, as in rafters, trusses, and floor joists, spanning members are oriented horizontally and are supported at their bearing points by supporting components. The supporting components may be oriented horizontally, such as beams and top plates, or they may be vertical, as in the case of posts and piers, or they may be a combination of horizontal and vertical components. During construction of the frame, each spanning member is set into position so that it is supported at its bearing points by the supporting components. The spanning member is then attached to the supporting component by toe-nailing or by means of brackets or braces. The method and manner of attaching spanning members to their supporting components is a vital determinant of the strength, durability, and wind-resistance of the frame and, hence, of the completed structure.

There are a number of problems that must be avoided or overcome when interconnecting framing components, and especially when interconnecting spanning members to their supporting components. For instance, it is necessary that the spanning member intersect its respective supporting components at the proper bearing points of the spanning member in order to achieve the load designs intended. Precision in determining the point of intersection between the spanning member and supporting component is particularly important when the spanning member extends beyond the edge of the supporting component, as in the example of a cantilevered truss connected to a top plate, because 1) the point of intersection is used to fix the distance that the spanning member will extend beyond the supporting component, and 2) the correct bearing point may be critical to the design function of the spanning member.

A second problem encountered in interconnecting a spanning member and a supporting component is that the two elements must be properly aligned with respect to each other in all three planes. In the typical box-type frame this means that the components must be square and plumb. By insuring that the upper surfaces of the opposing supporting components are level, and by marking the opposing supporting elements at equal intervals to indicate the intersection points of the spanning members and the supporting components, squaring the spanning member and supporting component in two planes is easily accomplished, especially when the supporting component is a top plate, beam or other elongate horizontal component. However, ensuring that the spanning member is perfectly plumb and orthogonal to the upper surface of the supporting component can be problematic, particularly when toe-nailing is the method of connecting the two components.

A third problem commonly encountered when interconnecting framing components is that toe-nailing, which is the traditional means of physically connecting a spanning member to its supporting component, frequently results in splitting the spanning member at or near its bearing point. Such splitting not only weakens the connection between the two components but it also contributes to instability of the spanning member in the vertical plane.

A fourth problem is that the strength of the connection between the spanning member and the supporting component is often insufficient to counteract uplift and shear forces produced by high winds. Uplift and shear forces are particularly troublesome with respect to roofing elements such as trusses and rafters. Consequently, it is desirable in the art of frame construction and design to maximize the strength of the connection between spanning members and their supporting components.

A fifth problem in the art is that during the process of toe-nailing a spanning member to its supporting component, the spanning member tends to slip along the surface of the supporting component. This to-and-fro movement of the two framing components relative to each other complicates the important goal of keeping the components squared and in proper bearing condition.

From the foregoing brief inventory of problems associated with frame construction it is evident that the field would benefit from a device that simultaneously orients, anchors, braces and interconnects two framing components, particularly spanning members and their supporting components.

3. Related Art

Although my invention is the only device known to me that resolves all of the foregoing problems simultaneously, a number of patented devices are directed at individual problems identified above.

The problem of overcoming uplift and shear forces is resolved by anchor straps and tie-downs, which are widely known in the art of frame construction. U.S. Pat. No. 5,561,949 to Knoth and U.S. Pat. No. 4,571,114 to Rionda et al., and U.S. Pat. No. 6,219,975 to Olden are examples of simple straps used to hold a truss to a top plate and/or stud, and thereby resist potentially destructive uplift and shear forces.

While the foregoing examples of tie-down devices are reasonably effective in resolving the problems of uplift and shear forces, these simple straps do not resolve problems related to properly orienting and squaring framing components relative to one another. U.S. Pat. No. 6,295,781 to Thompson, U.S. Pat. No. 5,109,646 to Colonias, and U.S. Pat. No. 4,714,372 to Commins disclose more complicated tie-down devices having multiple surfaces occupying multiple geometric planes. While such devices are effective in securing spanning members to support components and in facilitating the squaring of the interconnected framing components, the complex shapes of these devices create a whole new set of problems. For instance, they are difficult to handle, carry, store, and stack. Also, such devices cannot reasonably be pre-installed on framing components without making the components both difficult and dangerous to handle due to the sharp sheet metal flaps and tabs extending in multiple directions. Because such devices cannot be pre-installed they must be carried to the work site, stored there until needed, and then carried to the point at which they are used. This results in wasted materials and time as the loose pieces are dropped, misplaced, kicked around, and damaged.

My invention resolves all of the foregoing problems simultaneously by providing a device that interconnects, braces, and anchors a first framing component to a second framing component in a way that properly orients and squares the framing components relative to each other. When in a non-deployed configuration, the device can be pre-attached flush to the surfaces of the components so that the components can be handled and stored safely and conveniently without protruding flaps or tabs. At the time of interconnecting the two components, the device is converted to a deployed configuration with which the first component is braced, properly oriented, anchored, and interconnected to the second.

BRIEF SUMMARY OF THE INVENTION

The present invention is a framing component interconnecting device for simultaneously anchoring, orienting, bracing, and interconnecting framing components. It is particularly useful for interconnecting a spanning member and its supporting components. Among the many objectives met by the invention are 1) maintaining the long axis of the spanning member at a fixed and proper angle to the long axis of the supporting component; 2) preventing the two framing components from sliding to-and-fro with respect to each other during assembly of the frame, 3) providing a connection between the two components that is sufficiently strong to withstand uplift and shear forces, 4) holding the spanning member vertically, plumb, and on edge with respect to the upper surface of its supporting component, and 5) maintaining the proper bearing point of the spanning member on the supporting component.

Whilst the device may be used in a number of ways to facilitate frame construction, the preferred mode of use is to pre-attach it to the bearing points of a spanning member during pre-assembly of the spanning member. Because the device is not obtrusive while it is in what is referred to herein as a "non-deployed configuration," the device thus attached to a spanning member will not hinder or complicate storing, transporting, and handling the spanning member. The device incorporates straps and flaps, as disclosed below, that can be deployed to interconnect the spanning member to its supporting component once the spanning member has been raised into position.

The device comprises a connecting member used to attach the device to the spanning member. In the preferred embodiment the connecting member has a cross-sectional profile of a U-shaped channel. A bottom web having two opposing edges and two opposing ends forms the bottom of the U-shaped channel. Opposing and parallel connecting plates depend substantially orthogonally from the bottom web to form the sides of the U-shaped channel. The distance between the connecting plates is chosen to permit the device to fit snugly on an edge of the spanning member. In other words, the width of the channel is substantially equal to the thickness of the spanning member so that the channel frictionally accommodates the edge of the spanning member. A tongue extends linearly from at least one end of the bottom web to form a deployable anchor strap that can be deployed by being bent along an anchor strap hinge that forms a flexible continuity between the anchor strap and bottom web. At least one, and preferably both, of the aforementioned connecting plates has a deployable connecting flap cut into it such that three edges of the connecting flap are free and a fourth edge depends from the bottom web by means of a connecting flap hinge. The device includes one or more of a variety of means for connecting the device to the framing components, such as nailing holes, bolt-holes, and/or integral nails.

In using my invention, the device is affixed to one edge of the spanning member at approximately a design bearing point. This is done by simply placing the edge of the spanning member in the U-shaped channel formed by the bottom web and the connecting plates and then securing the device to the spanning member by means of whatever connecting means is chosen. The spanning member can be stored, handled, and transported with the device thus affixed. During construction of the frame, the spanning member with the device secured thereto is lifted into place and properly oriented to the supporting component to which the spanning member is to be interconnected. The anchor strap is then urged downwards about the anchor strap hinge until the strap engages the supporting component and lies flat against the vertical inner or outer surface of the supporting component. The anchor strap is then connected to the supporting component by whatever connection means is chosen—generally nails driven through nailing holes in the anchor strap and into the supporting component. The connecting flaps are pried free, urged flush against the upper surface of the supporting component, and secured to the supporting component by the connecting means chosen, generally nails driven through nailing holes in the connecting flaps and into the supporting component.

My invention has a number of features that facilitate proper alignment of the two framing components. First, the device is pre-attached to the spanning member at the bearing point of the spanning member such that an edge of the device will serve as a sight-line to indicate when the bearing point is properly aligned on the supporting component. This allows the spanning member to be quickly positioned correctly lengthwise with respect to the supporting component. Second, when the components are in proper position one to the other, the anchor strap hinge also acts as a sight-line because it is juxtaposed with the upper edge of the vertical surface of the supporting component. When the anchor strap is bent downwards about its hinge and flush against the supporting component, the two components are necessarily brought into proper alignment. Third, when the anchor strap is deployed and lies flush against the vertical surface of the supporting component, the builder knows that the two framing components are square. Fourth, the connecting plates hold the spanning member plumb and vertical with respect to the upper surface of the supporting component. Fifth, the connecting flaps, when deployed and nailed to the supporting component, prevent rotation and sliding of the spanning member relative to the supporting component.

These and other novel advantages of my invention will be easily appreciated by referring to the drawings and to the detailed disclosures made below.

BRIEF DESCRIPTION OF THE DRAWINGS

In the drawings identical reference numbers are employed to identify identical elements and primed reference numerals are employed to identify analogous elements. The sizes and relative positions of the elements in the drawings are not necessarily drawn to scale. For example, thicknesses are not drawn to scale and are generally enlarged to insure comprehension of the drawings.

FIG. 1 is a perspective drawing of the invention in its non-deployed configuration.

FIG. 2 is a top view of a sheet metal blank of the invention at an intermediate stage of its manufacture.

FIG. 6. is a cross-section of an embodiment of the invention employing integral teeth.

FIG. 7. is a cross-section of the embodiment shown in FIG. 6 attached to a framing component.

DETAILED DESCRIPTION OF THE INVENTION

Figure 3:
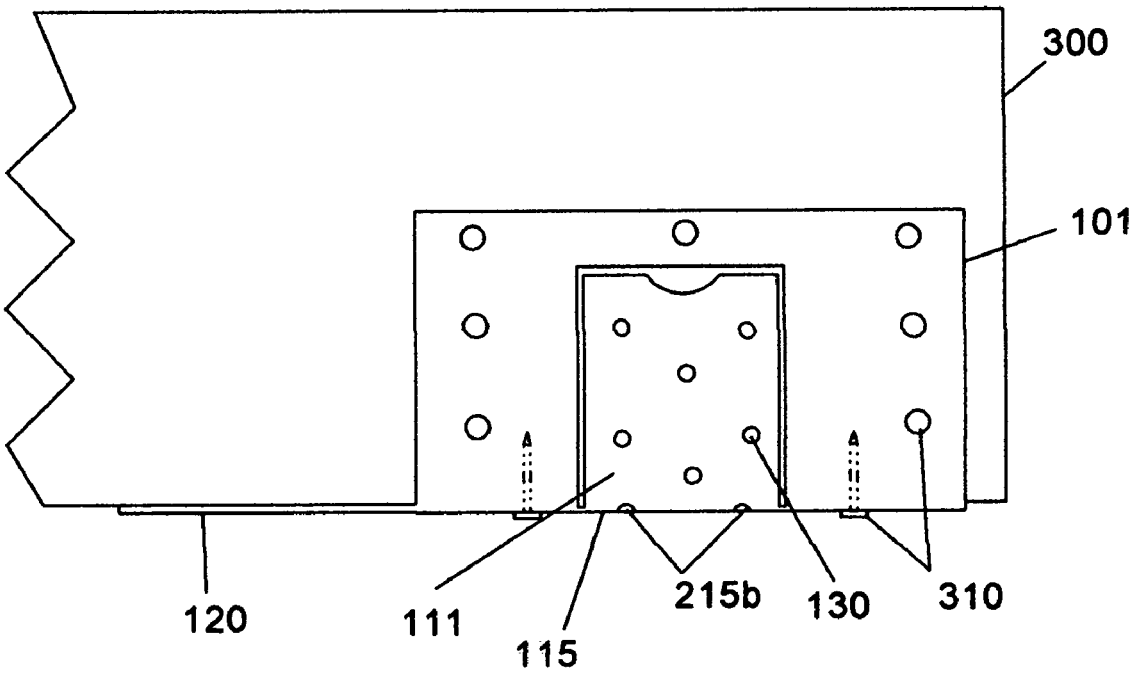
FIG. 3 is a side view showing the invention in its non-deployed configuration and pre-attached to a spanning member.

The inventive concepts and novel features of my invention are described herein with reference to specific embodiments, which embodiments represent the best mode known to me for making and using my invention. However, it is to be noted that the embodiments as described herein are not meant to limit the scope of my invention but rather are representative of many possible embodiments that incorporate the inventive concepts of my invention.

1. STRUCTURAL FEATURES

In the preferred embodiment, the invention is fabricated from sheet metal that is sufficiently thick to meet the necessary strength requirements and yet sufficiently flexible to allow the various flaps and straps to be deployed as described below. Sheet metal of about 18 to 22 gauge is appropriate for most applications. Of course, the invention may be made of any material or combination of materials having the requisite strength and flexibility characteristics.

The invention exists in two configurations: a non-deployed configuration that is convertible to a deployed configuration. The non-deployed configuration is the configuration in which the invention exists when it is attached to a framing component during the assembly, storage, transport and handling of the component. The deployed configuration is the configuration in which the invention exists when interconnecting two framing components.

FIG. 1 shows the invention as it appears in the non-deployed configuration. Connecting member 140 is formed by a first connecting plate 100 and a parallel second connecting plate 101 depending substantially orthogonally from the opposing edges 136/136' of bottom web 105, such that the connecting plates and bottom web form a U-shaped channel. A first connecting flap 110 depends substantially orthogonally from edge 136 of the bottom web. A second connecting flap 111 depends substantially orthogonally from the opposing edge 136' of the bottom web. Connecting flap hinge 115 forms a flexible continuity between connecting flap 111 and edge 136' of the bottom web. Connecting flap hinge 115' forms a flexible continuity between connecting flap 110 and edge 136 of the bottom web. These hinges facilitate the conversion of the connecting flaps from the non-deployed configuration to the deployed configuration by allowing the flaps to be more easily urged downwards, as discussed below. When the device is in its non-deployed configuration as shown in FIG. 1, each connecting flap is substantially co-planar with the connecting plate depending from the same edge of the bottom web; i.e. connecting flap 111 and connecting plate 101 are substantially co-planar, and connecting flap 110 and connecting plate 100 are substantially co-planar.

As shown in FIG. 1, anchor strap 120 depends from one end of the bottom web. While in the non-deployed configuration shown in FIG. 1, the anchor strap is substantially co-planar with the bottom web. An anchor strap hinge 126 facilitates the conversion of the anchor strap from the non-deployed configuration to the deployed configuration. The hinge shown in FIG. 1 is produced by a line etched or scored into the surface of the anchor strap; however, hinge holes, discussed below, can also be employed.

A plurality of nailing holes 130 perforate the surfaces of the bottom web, connecting plates, connecting flaps, and anchor strap.

Fabricating the invention from sheet metal is carried out by techniques well known to artisans in the field of sheet metal fabrication. In FIG. 2 the invention is shown at an intermediate step in the fabrication process. A sheet metal blank 210 is first cut to shape as shown in FIG. 2. The blank includes what will become the first connecting plate 100, the second connecting plate 101, the bottom web 105, and the anchor strap 120. The blank is multiply perforated to produce the nailing holes 130. One or more hinge holes 215*a-c* comprise the connecting flap hinges 115 and 115' and the anchor strap hinge 125. Connecting flaps 110 and 111 are cut into their respective connecting plates. Pry notches 135 and 135' are provided in the connecting flaps. The connecting plates are pressed into their final parallel and opposing positions by bending the blank along the lines shown in FIG. 2 and forming the U-shaped channel.

2. FUNCTIONAL FEATURES

FIG. 3. shows a side view of my invention attached to a framing component such as a spanning member 300. The device fits snugly on the spanning member's edge because the width of the U-shaped channel formed by the bottom web and connecting plates is substantially equal to the thickness of the spanning member. Nails 310 penetrate connecting plate 101, connecting plate 100 (not shown), and the bottom web secure the device to the spanning member.

When the device is in a non-deployed configuration for storage and transport of the supporting member as shown in FIG. 3, anchor strap 120 is substantially co-planar with the bottom web and lies flat against the lower surface of the spanning member. Connecting flaps 111 (and 110, not shown) are flat against the vertical surfaces of the spanning member and are substantially co-planar with their respective connecting plates. Thus, no flaps, tabs, or surfaces extend out from the supporting member to injure workers or complicate handling of the supporting member. The connecting flap hinge 115 is formed by one or more hinge holes 215*b*, which facilitate the bending of the connecting flap downwards as described below. Similar hinge holes 215*a* are used to form the anchor strap hinge (See FIG. 2).

Figure 4:
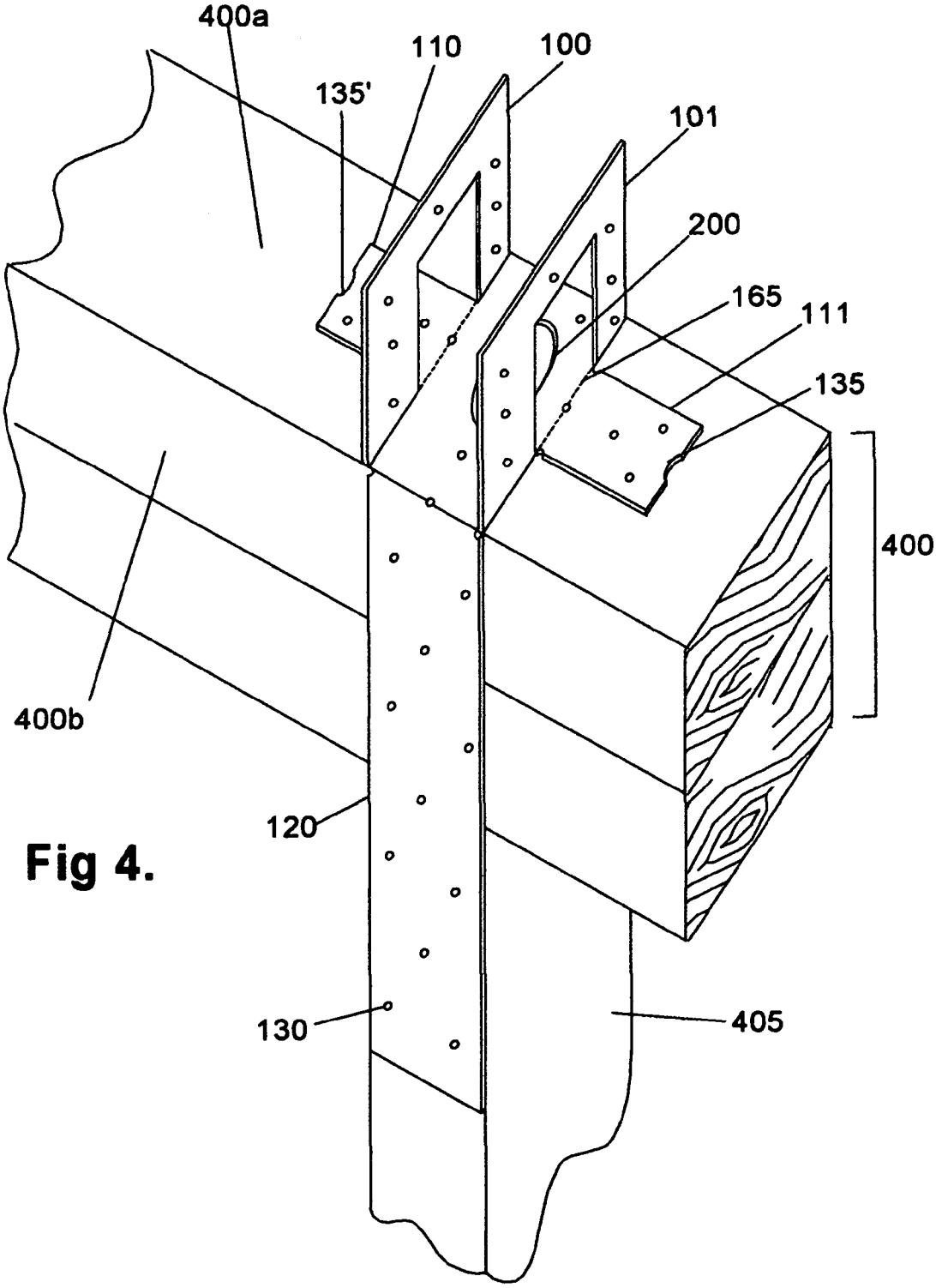
FIG. 4 is a perspective drawing showing the relationship of the invention in its deployed configuration to a supporting component. The spanning member has been deleted for clarity.
Figure 5:
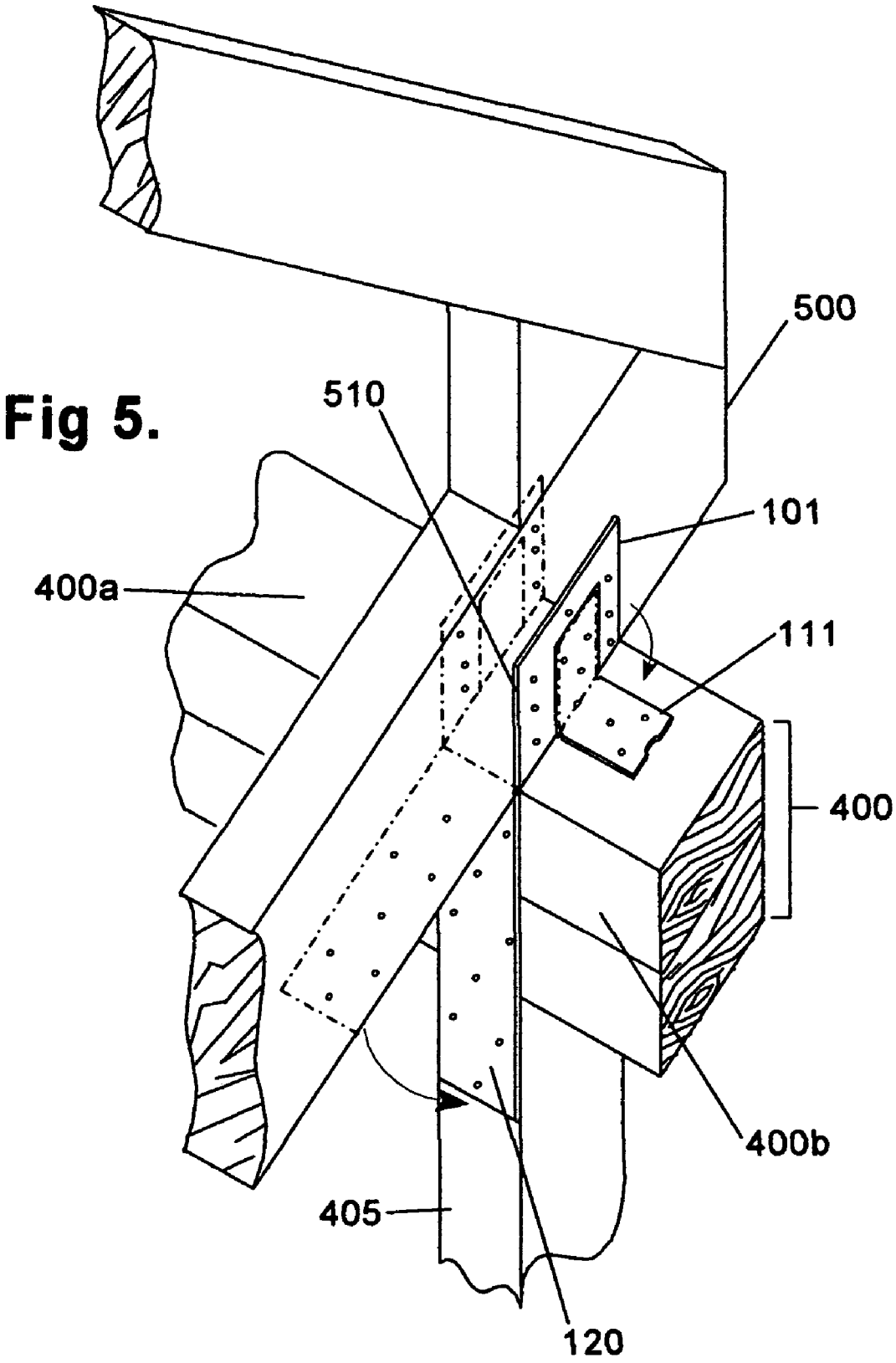
FIG. 5 is a perspective drawing showing the invention in its deployed configuration interconnecting a spanning member and its supporting component.

In the example shown in FIGS. 4 and 5, the supporting component is a horizontal top plate 400 connected to a vertical stud 405. FIG. 4 shows the physical relationship of my invention with respect to the supporting component once the invention is in its final, deployed position. The spanning member has been deleted from this figure in order to show clearly how the device connects to the supporting component. When the spanning member is properly positioned on the supporting component, anchor strap 120 is urged from the non-deployed configuration shown in FIG. 3. to the deployed position shown in FIG. 4 in which the anchor engages the supporting component. This is done simply by engaging the anchor strap with the claw of a hammer and bending it down and away from the lower surface of the spanning member. Deployment of the anchor strap is facilitated by the anchor strap hinge (125, FIGS. 1 & 4). Once the anchor strap is free of the spanning member, the anchor strap is struck sharply with the hammer to force it flush against the vertical surface 400*b* of the supporting component. Minor adjustments in the position of the spanning member are then made by tapping the spanning member until the surface of the anchor strap is flat against the supporting component. This insures that the spanning member and supporting component are squared with respect to their long axes. Nails are then hammered into the supporting component through nail holes 130 in the surface of the anchor strap to secure the device to the supporting component.

Connecting flaps 110 and 111 are deployed by inserting a hammer claw, screwdriver, or other suitable instrument into pry notches 135 and 135' provided to facilitate deployment of the connecting flaps, and urging the connecting flaps free of the connecting plate. Once free of the connecting plate, the connecting flaps are then struck sharply with a hammer to force them flush against the upper surface 400*a* of the top plate, thus engaging the top plate. This step is facilitated by a connecting flap hinge 115 between the connecting flap and bottom web. Nails are driven through nailing holes 130 in order to connect the connecting flaps to the upper surface of the supporting component.

FIG. 5 shows the physical relationship between the deployed configuration of my invention, a spanning member, and a supporting component when the spanning member and supporting component have been interconnected using the invention. Top plate 400 and stud 405 support spanning member 500, which in this example is a cantilevered truss. The device is attached to the truss by nails penetrating the connecting plate 101 and bottom web (not visible) as described above. Anchor strap 120 has been deployed by urging it out of its planar relationship with the bottom web until it engages the supporting component and then nailing it to the vertical surface of the supporting component. Connecting flap 111 has been deployed by urging it out of its planar relationship with the connecting plate until it engages the supporting component and then nailing it to the upper surface of the supporting component.

It will be appreciated that to insure the proper overhang of the truss past the supporting components and the proper positioning of the bearing point upon the supporting component, the device must be attached to the truss such that edge 510 of connecting plate 101 is in alignment with the vertical surface 400*b* of the top plate. Consequently, once the device is attached to the bearing point of the truss, when the truss is lifted into position and placed on the top plate, edge 501 provides a convenient sight-line for indicating when the truss is properly positioned lengthwise with respect to the top plate. Engaging the anchor strap by bending it down against the supporting component further insures proper placement of the spanning member on the supporting component.

From the foregoing, it will be appreciated that my invention greatly facilitates the process of constructing frames because the device can be accurately affixed at the point and time of fabrication of pre-fabricated and pre-cut spanning members such as trusses, rafters, and joists. The spanning members can then be stored, handled, and transported with the device attached because the anchor strap and connecting flaps are flush against the surface of the spanning member without any protruding flaps, tabs, or surfaces. Once the spanning member is lifted into position at the construction site, the device is used to precisely position the spanning member without having to make additional measurements on site. No additional clips, anchors, or brackets need to be installed, handled, or carried around by the builders.

3. DETAILS, EMBELLISHMENTS, AND VARIATIONS a. Hinge Construction

Any of the hinges disclosed herein may be constructed by various means that achieve the objective of facilitating the bending the elements with respect to each other as disclosed above. For instance, a hinge formed of substantially co-linear hinge holes achieves this objective. Score-lines cut or pressed into the surface of the device may also be used to form the hinges. If the metal or other material used to fabricate the device is sufficiently thin, the hinge may be formed simply by the process of bending the anchor strap and connecting flaps relative to the bottom web.

b. Toe-Nailing Fenestration

As shown in FIGS. 4 and 5, once the connecting flaps are deployed, the spanning member is accessible through the openings in the connecting plate. It is thus possible to exploit this opening for toe-nailing the spanning member to the supporting component. As shown in FIGS. 2 and 4, toe-nailing fenestration 200 is provided in the bottom web to accommodate toe-nailing by allowing the nail to pass through the bottom web and into the supporting component.

The device thus obviates problems caused by traditional toe-nailing in four ways: First, it limits the amount of toe-nailing required to interconnect the framing components. Second, it encases the spanning member on three sides and thus reduces splintering caused by toe-nailing. Third, it overcomes material weakening and vertical instability of the spanning member caused by splintering. Fourth, because the spanning member is firmly attached to the supporting component prior to toe-nailing, the spanning member cannot slip along the surface of the supporting component during toe-nailing.

c. Connecting Means

In using the invention to interconnect two framing components, various connection means may be employed, including hammered nails, hammered staples, pneumatically driven nails, pneumatically driven staples, bolts, and screws. Nailing holes for accepting nails and staples can be provided in the surfaces of the connecting plate, anchor strap, and connecting flaps, as disclosed above. With respect to the connecting plates, one of a pair of opposing nailing holes can be made significantly larger than the other so that a long nail can be driven into the smaller hole, completely through the spanning member and out of larger hole in the opposing connecting plate. Then the exposed end of the nail is bent or crimped. Bolt-holes can be provided so that lag bolts or carriage bolts can be employed. Bolt-holes are particularly advantageous when working with metal framing components, which are not amenable to nailing.

Integral protuberances such as integral nails and teeth can also be used as a connecting means, particularly with respect to the connecting plates as shown in FIG. 6. Although integral protuberances are also effective in connecting the anchor strap and connecting flaps to the supporting component, such protuberances are problematic when the device is pre-attached to a framing component because the protuberances stick out from the surface of the device and framing component. This makes handling and storing components difficult and dangerous due to the protruding teeth, integral nails, etc.

As disclosed above, it is generally desirable that the connecting plates depend orthogonally from the bottom web so that the connecting member fits snugly to the spanning member as shown in FIGS. 3 and 5. However, when using inwardly-extending protuberances integral to connecting plates for attaching the connecting member to the spanning member, it is desirable that the connecting plates are splayed so that the device can be easily fit over the edge of the spanning member in spite of the protuberances. This is demonstrated by FIG. 6, which represents a cross-section taken through the U-shaped channel of a device employing inwardly-extending integral teeth. Because integral teeth 600*a-c* extend into the channel, they would prevent attachment of the device to the edge of the spanning member if not for the fact that the connecting plates are splayed such that internal angle a between each connecting plate and the bottom web is greater than 90 degrees.

FIG. 6 also demonstrates a length-gradient of the integral protuberances, with the protuberances 600*a* adjacent the upper edge of the connecting plate being longest, the protuberances 600*b* at or near the middle of the connecting plate being of intermediate length, and the protuberances 600*c* at the bottom of the connecting plate being shortest. Because of this length-gradient, the splaying of the connecting plates can be used to good advantage to accommodate longer protuberances at the upper end of the connecting plates. When the spanning member is placed within the channel as shown in FIG. 7 and the connecting plates are pressed or driven flush against the surfaces of the spanning member, the integral teeth sink into the spanning member thereby holding it securely. One or more nails 710 driven through the bottom web and into the spanning member contribute additional strength to the connection.

It will also be appreciated that given the power of pneumatic nail-drivers, the invention need not have any connecting holes at all. Strong connections can be made with nails or staples driven through the sheet metal and into the framing components.

d. Variations in Structure

The foregoing disclosure describes a connecting member in the form of a U-shaped channel for receiving the spanning member. However, in some circumstances it may be more advantageous for the connecting member to be L-shaped, comprising a bottom web from which depends only one connecting plate and one connecting flap.

It will also be appreciated from FIGS. 3 and 4 that the device may be attached to the supporting component with the anchor strap on either the inside or the outside of the supporting component, depending on the geometrical limitations to access at a specific location. It is also advantageous in some situations to have two anchor straps, one extending from each end of the bottom web in order to double the anchoring forces at each connection—for instance in coastal areas where hurricanes and high winds are particularly strong and prevalent.

In most situations the length of the bottom web is not critical; however, it is generally desirable that the length of the bottom web be equal to or less than the width of the supporting component to which it is attached. However, when devices having two anchor straps are used, it is essential that the length of the bottom web be substantially equal to the width of the supporting component so that both anchor strap hinges are positioned above the edges of their respective supporting components.

When the spanning member is supported by a horizontal member such as a top plate, the length of the anchor strap is generally substantially equal to the thickness of the top plate. In some situations, as shown in FIGS. 4 and 5, the bearing point of the supporting member is directly above a stud, and it is desirable that the anchor strap be sufficiently long to engage both the top plate and the stud.

Upon consideration of the figures and the foregoing paragraphs it will be apparent that the terms "connecting plate" and "connecting flap" as used herein are primarily functional terms and are interchangeable from a structural point of view. For instance, referring to FIG. 1, it is possible to attach the connecting member 140 to the spanning member by employing connecting flap 111 as a "connecting plate." Connecting plate 101 can then be deployed as a "connecting flap" by bending it downward and connecting it to the supporting component.

4. SUMMARY

From the foregoing description the novelty, utility, means of constructing, and means of using my invention will be readily apprehended. However, the foregoing description merely represents the best mode known to me as of the present date. The embodiment herein disclosed is not meant to be exclusive of other ways of making and using my invention, and it will be obvious to those of average skill in the field that other means of producing and/or using my invention lie within the scope of this disclosure and the claims below. It is to be understood that my invention is not limited to the embodiment disclosed above but encompasses any and all embodiments within the scope of the following claims.

I claim:

1. A device for connecting and anchoring a first framing component of a construction frame to a second framing component of a construction frame, said device comprising:

a. at least one connecting member for attaching said device to the first framing component, said connecting member comprising:
   i. a bottom web having a first end, a second end, a first edge, and a second edge;
   ii. at least one connecting plate depending approximately orthogonally from said first edge; and,
   iii. attachment means for attaching said connecting plate to the first framing component;

b. at least one deployable anchor strap depending from at least one end of said bottom web, said anchor strap being substantially co-planar with said bottom web when the device is in the non-deployed configuration, and said anchor strap lying substantially flush against the vertical surface of the second framing component when the device is in the deployed state;

c. at least one deployable connecting flap cut into said connecting plate such that three edges of said connecting flap are free and the fourth edge depends from said edge of said bottom web, whereby said connecting flap is substantially co-planar with said connecting plate when the device is in the non-deployed configuration and is substantially flush against the upper surface of the second framing component when the device is in the deployed configuration;

d. means for connecting said connecting flap to the second framing component; and e. means for connecting said anchor strap to the second framing component.

2. The framing component interconnecting device of claim 1 further comprising means for facilitating the deployment of said deployable anchor strap.

3. The framing component interconnecting device of claim 2 wherein said means for facilitating the deployment of said deployable anchor strap comprises a hinge.

4. The framing component interconnecting device of claim 2 wherein said means for facilitating the deployment of said deployable anchor strap comprises at least one hinge hole.

5. The framing component interconnecting device of claim 1 further comprising means for facilitating the deployment of said deployable connecting flap.

6. The framing component interconnecting device of claim 5 wherein said means for facilitating the deployment of said deployable connecting flap comprises a hinge.

7. The framing component interconnecting device of claim 5 wherein said means for facilitating the deployment of said deployable connecting flap comprises at least one hinge hole.

8. The framing component interconnecting device of claim 5 wherein said means for facilitating the deployment of said deployable connecting flap comprises a pry means.

9. The framing component interconnecting device of claim 8 wherein in said pry means comprises at least one pry notch.

10. The framing component interconnecting device of claim 1 wherein said bottom web comprises at least one toe-nailing fenestration.

11. The framing component interconnecting device of claim 1 wherein said connecting means for connecting said connecting flap to the second framing component is chosen from the group consisting of integral protuberances, nails, staples, bolts, and screws.

12. The framing component interconnecting device of claim 1 wherein said connecting means for connecting said anchor strap to the second framing component is chosen from the group consisting of integral protuberances, nails, staples, bolts, and screws.

13. The framing component interconnecting device of claim 1 wherein said connecting member is a U-shaped channel formed by said bottom web and two of said connecting plates.

14. The framing component interconnecting device of claim 13 wherein the width of said U-shaped channel is chosen to allow said device to fit snugly onto an edge of the first framing component.

15. A device for connecting and anchoring a first framing component of a construction frame to a second framing component of a construction frame, said device comprising:

a. at least one connecting member for attaching said device to the first framing component, said connecting member comprising:

i. a bottom web having a first end, a second end, a first edge, and a second edge;

ii. at least one connecting plate depending from said first edge and splayed such that the internal angle between said bottom web and said connecting plate is greater than 90 degrees; and, iii. a plurality of inwardly-extending protuberances integral to said connecting plate;

b. at least one deployable anchor strap depending from at least one end of said bottom web, said anchor strap being substantially co-planar with said bottom web when the device is in the non-deployed configuration, and said anchor strap lying substantially flush against the vertical surface of the second framing component when the device is in the deployed state;

c. at least one deployable connecting flap cut into said connecting plate such that three edges of said connecting flap are free and the fourth edge depends from said edge of said bottom web, whereby said connecting flap is substantially co-planar with said connecting plate when the device is in the non-deployed configuration and is substantially flush against the upper surface of the second framing component when the device is in the deployed configuration;

d. means for connecting said connecting flap to the second framing component; and e. means for connecting said anchor strap to the second framing component.

16. The framing component interconnecting device of claim 15 wherein the length of said inwardly-extending protuberances decreases between the upper edge of said connecting plate and said bottom web.

17. A method of connecting and anchoring a first framing component of a construction frame to a second framing component of a construction frame, said method comprising the steps of:

(a) determining a bearing point on the first framing component;

(b) pre-attaching a connecting and anchoring device to the first framing component at approximately the bearing point determined in step (a), said connecting and anchoring device having at least one connection plate, at least one deployable anchor strap, and at least one deployable connection flap, the anchor strap and connection flap being in their non-deployed configurations at the time the device is pre-attached to the first framing component;

(c) lifting the first framing component into place with respect to the second framing component;

(d) orienting the first framing component with respect to the second framing component;

(e) deploying the anchor strap by urging it flat against a vertical surface of the second framing component;

(f) deploying the connecting flap by urging it flat against the upper surface of the second framing component;

(g) connecting the deployed connecting flap to the second framing component; and, (h) connecting the deployed anchor strap to the second framing component.

18. The method of claim 17 wherein step (b) is preformed by attaching the interconnecting and anchoring device to an edge of the first framing component.

* * * * *